US008119897B2

(12) United States Patent
Teie

(10) Patent No.: US 8,119,897 B2
(45) Date of Patent: Feb. 21, 2012

(54) PROCESS OF AND APPARATUS FOR MUSIC ARRANGEMENTS ADAPTED FROM ANIMAL NOISES TO FORM SPECIES-SPECIFIC MUSIC

(76) Inventor: David Ernest Teie, Washington, DC (US)

( * ) Notice: Subject to any disclaimer, the term of this patent is extended or adjusted under 35 U.S.C. 154(b) by 0 days.

(21) Appl. No.: 12/511,761

(22) Filed: Jul. 29, 2009

(65) Prior Publication Data

US 2010/0024630 A1 Feb. 4, 2010

Related U.S. Application Data

(60) Provisional application No. 61/084,313, filed on Jul. 29, 2008.

(51) Int. Cl.
*G10H 1/00* (2006.01)

(52) U.S. Cl. ..... 84/609; 84/615; 84/616; 84/649; 84/653

(58) Field of Classification Search ..... 84/600–602, 84/609, 615, 616, 649, 653, 654
See application file for complete search history.

(56) References Cited

U.S. PATENT DOCUMENTS 3,539,701 A * 11/1970 Milde ..... 84/641
5,038,658 A * 8/1991 Tsuruta et al. ..... 84/461
5,465,729 A * 11/1995 Bittman et al. ..... 600/545
5,540,235 A * 7/1996 Wilson ..... 600/554
5,814,078 A * 9/1998 Zhou et al. ..... 607/1
5,974,262 A * 10/1999 Fuller et al. ..... 710/18
6,149,492 A * 11/2000 Davis, Jr. ..... 446/397
6,328,626 B1 * 12/2001 Eubanks ..... 446/397
6,487,817 B2 * 12/2002 Airaudi ..... 47/58.1 R
6,743,164 B2 * 6/2004 Airaudi et al. ..... 600/27
6,930,235 B2 * 8/2005 Sandborn et al. ..... 84/483.2
7,011,563 B2 * 3/2006 Ady et al. ..... 446/207
7,037,167 B2 * 5/2006 Primos et al. ..... 446/204
7,173,178 B2 * 2/2007 Kobayashi ..... 84/645
7,227,072 B1 * 6/2007 Weare ..... 84/609
7,247,782 B2 * 7/2007 Hennings et al. ..... 84/600
7,252,571 B1 * 8/2007 Bohman et al. ..... 446/421
7,256,339 B1 * 8/2007 Carmichael ..... 84/600

(Continued)

OTHER PUBLICATIONS

Luis F. Baptista et al., "Why Birdsong is Sometimes Like Music", Perspectives in Biology and Medicine, Summer, 2005, pp. 426-443, vol. 48, No. 3, The Johns Hopkins University Press.

(Continued)

*Primary Examiner* — David S. Warren
(74) *Attorney, Agent, or Firm* — Buchanan Ingersoll & Rooney PC

(57) ABSTRACT

Exemplary embodiments include an apparatus and process of forming species-specific music. The means and method for carrying out the process include: (1) recording sounds created by a specific species in emotional states; (2) identifying elemental sounds of the specific species; (3) associating specific elemental sounds with presupposed emotional states of the specific species; (4) identifying sounds of at least one musical instrument that has a characteristic approximating at least one aspect of at least one elemental sound associated with the specific species; and (5) selectively generating at least one sound identified among sounds of musical instruments that mimic at least one aspect of at least one elemental sound associated with said specific species, but the generated sound is not a recording or recreation of the detected sounds of the specific species. If the actual calls of a species were to be used in the music for that species the clear identification by the listening members would make the emotional response to the music subject to habituation.

20 Claims, 17 Drawing Sheets

U.S. PATENT DOCUMENTS

| | | | | |
|---|---|---|---|---|
| 7,619,155 | B2 * | 11/2009 | Teo et al. | 84/616 |
| 7,723,603 | B2 * | 5/2010 | Moffatt | 84/610 |
| 8,016,637 | B2 * | 9/2011 | Pribbanow | 446/202 |
| 2001/0018311 | A1 * | 8/2001 | Musacchia | 446/418 |
| 2002/0064094 | A1 * | 5/2002 | Gaspari | 367/139 |
| 2002/0077019 | A1 * | 6/2002 | Carlton | 446/200 |
| 2004/0060424 | A1 * | 4/2004 | Klefenz et al. | 84/616 |
| 2004/0065188 | A1 * | 4/2004 | Stuebner et al. | 84/723 |
| 2004/0186708 | A1 * | 9/2004 | Stewart | 704/207 |
| 2004/0255757 | A1 * | 12/2004 | Hennings et al. | 84/600 |
| 2005/0076768 | A1 * | 4/2005 | Pfortmiller et al. | 84/380 R |
| 2005/0086052 | A1 * | 4/2005 | Shih | 704/207 |
| 2005/0115381 | A1 * | 6/2005 | Bryden et al. | 84/600 |
| 2005/0229769 | A1 * | 10/2005 | Resnikoff | 84/483.2 |
| 2006/0021494 | A1 * | 2/2006 | Teo et al. | 84/616 |
| 2006/0090632 | A1 * | 5/2006 | Ludwig | 84/645 |
| 2006/0096447 | A1 * | 5/2006 | Weare et al. | 84/616 |
| 2007/0000372 | A1 * | 1/2007 | Rezai et al. | 84/609 |
| 2008/0105102 | A1 * | 5/2008 | Stannard | 84/402 |
| 2008/0250914 | A1 * | 10/2008 | Reinhart et al. | 84/645 |
| 2008/0264239 | A1 * | 10/2008 | Lemons et al. | 84/477 R |
| 2009/0013851 | A1 * | 1/2009 | Copeland | 84/411 R |
| 2009/0107319 | A1 * | 4/2009 | Stannard | 84/402 |
| 2009/0123998 | A1 * | 5/2009 | Zdanovsky | 435/320.1 |
| 2009/0191786 | A1 * | 7/2009 | Pribbanow | 446/207 |
| 2010/0005954 | A1 * | 1/2010 | Higashidate et al. | 84/725 |
| 2010/0024630 | A1 * | 2/2010 | Teie | 84/723 |
| 2010/0236383 | A1 * | 9/2010 | Vogel | 84/600 |
| 2010/0254676 | A1 * | 10/2010 | Ebato | 386/96 |

OTHER PUBLICATIONS

Maxeen Biben et al., "Playback Studies of Affiliative Vocalizing in Captive Squirrel Monkeys: Familiarity as a Cue to Response", Behaviour 117 (1-2), 1991, pp. 1-19, E.J. Brill, Leiden.

Jason C. Birnholz et al., "The Development of Human Fetal Hearing", American Association for the Advancement of Science, Nov. 1983, pp. 516-518, vol. 222, No. 4623.

Anne J. Blood et al., "Intensely pleasurable responses to music correlate with activity in brain regions implicated in reward and emotion", Montreal Neurological Institute, McGill University, Jul. 2001, 11 pages, vol. 98, No. 20.

Matthew W. Campbell et al., "Vocal Response of Captive-reared Saguinus oedipus During Mobbing", Department of Psychology, University of Wisconsin-Madison, Jun. 2005, vol. 28, pp. 257-270, Springer Science & Business Media, LLC.

Shirley Fecteau et al., "Amygdala responses to nonlinguistic emotional vocalizations", NeuroImage 36, Aug. 2006, pp. 48-487, Elsevier Inc.

W. Tecumseh Fitch, "The biology and evolution of music: A comparative perspective", School of Psychology, University of St. Andrews, Cognition 100, 2006, pp. 173-215, Elsevier B.V.

W. Tecumseh Fitch et al., "The descended larynx is not uniquely human", Jan. 2001, vol. 268, pp. 1669-1675, The Royal Society.

W. Tecumseh Fitch et al., "Vocal Production in Nonhuman Primates: Acoustics, Physiology, and Functional Constraints on "Honest" Advertisement", American Journal of Primatology, 1995, vol. 37, pp. 191-219, Wiley-Liss, Inc.

Timothy D. Griffiths et al., "The planum temporale as a computational hub", Jul. 2002, Trends in Neurosciences, vol. 25, No. 7, pp. 348-353, Elsevier Inc.

Hao Huang et al., "White and gray matter development in human fetal, newborn and pediatric brains", NeuroImage, 2006, vol. 33, pp. 27-38, Elsevier Inc.

Patrick N. Juslin et al., "Emotional responses to music: The need to consider underlying mechanisms", Behavioral and Brain Sciences, 2008, vol. 31, pp. 559-621, Cambridge University Press.

Josh McDermott et al., "Nonhuman primates prefer slow tempos but dislike music overall", Cognition 104, 2007, pp. 654-668, Elsevier B.V.

Josh McDermott et al., "The Origins of Music" Innateness, Uniqueness, and Evolution, Music Perception, vol. 23, Issue 1, pp. 29-59, The Regents of the University of California.

Josh H. McDermott, "What Can Experiments Reveal About the Origins of Music?", 2009, vol. 18, No. 3, pp. 164-168, Association for Psychological Science.

Josh McDermott, "The evolution of music", Nature, May 2008, vol. 287-288, Nature Publishing Group.

Eugene S. Morton, "On the Occurrence and Significance of Motivation-Structural Rules in Some Bird and Mammal Sounds", The American Naturalist, Sep.-Oct. 1977, vol. 111, No. 981, pp. 855-869, The University of Chicago Press for the American Society of Naturalists.

Jaak Panksepp et al., "Emotional sounds and the brain: the neuro-affective foundations of musical appreciation", Behavioural Processes, 2002, vol. 60, pp. 133-155, Elsevier Science B.V.

Anderson J. Parvizi et al., "Pathological laughter and crying", Sep. 2001, vol. 124, No. 9, pp. 1708-1719, Oxford University Press.

Aniruddh D. Patel, "Musical Rhythm, Linguistic Rhythm, and Human Evolution", Music Perception, vol. 24, Issue 1, pp. 99-104, The Regents of The University of California.

Aniruddh D. Patel et al., "Experimental Evidence for Synchronization to a Musical Beat in a Nonhuman Animal", Current Biology, May 2009, vol. 19, pp. 827-830, Elsevier Ltd.

Camillo Porcaro et al., "Fetal auditory responses to external sound and mother's heart beat: Detection improved by Independent Component Analysis", Brain Research 1101, 2006, pp. 51-58, Elsevier B.V.

Debra Porter, "Music Discriminations by Pigeons", Journal of Experimental Psychology: Animal Behavior Processes, 1984, vol. 10, No. 2, pp. 138-148, American Psychological Association, Inc.

Robert M. Poss, "Distortion is Truth", Leonardo Music Journal, 1998, vol. 8, pp. 45-48, The MIT Press.

David A. Schwartz et al., "Pitch is determined by naturally occurring periodic sounds", Hearing Research, 194, 2004, pp. 31-46, Elsevier B.V.

Denis Querleu et al., "Fetal hearing", Abstract, European Journal of Obstetrics and Gynecology, 1988, one page, Elsevier Ireland Ltd.

Ryan Remedios et al., "Monkey drumming reveals common networks for perceiving vocal and nonvocal communication sounds", 2009, 19 pages.

Douglas S. Richards et al., "Sound Levels in the Human Uterus", Intrauterine Sound Levels, Aug. 1992, vol. 80, No. 2, pp. 186-190, The American College of Obstetricians and Gynecologists.

Simone Schehka et al., Acoustical expression of arousal in conflict situations in tree shrews (*Tupaia belangeri*), 2007, J. Comp. Physiol, vol. 193, pp. 845-852, Springer-Verlag.

David A. Schwartz et al., "Pitch is determined by naturally occurring periodic sounds", Hearing Research 194, 2004, pp. 31-46, Elsevier B.V.

Laurel J. Trainor et al., "Preference for Sensory Consonance in 2- and 4-Month-Old Infants", Music Perception, 2002, vol. 20, No. 2, pp. 187-194, The Regents of the University of California.

Kathleen Wermke et al., "Newborns' Cry Melody is Shaped by Their Native Language", Dec. 2009, Current Biology 19, pp. 1994-1997, Elsevier Ltd.

Istvan Winkler et al., "Newborn infants detect the beat in music", Abstract, Dec. 2008, 13 pages, Duke University Medical Center.

Anthony A. Wright et al., "Music Perception and Octave Generalization in Rhesus Monkeys", Journal of Experimental Psychology: General, 2000, vol. 129, No. 3, pp. 291-307, The American Psychological Associates, Inc.

Marcel R. Zentner et al., "Perception of music by infants", Nature, Sep. 1996, vol. 383, p. 29, Nature Publishing Group.

* cited by examiner

FIG. 3A1

Tamarin Vocalizations

Ascending Multi-whistle

♩ = 360

(By animals in huddles, by mothers nursing infants.)

Chevron Chatter

♩ = 360

(Towards humans when animal is netted or placed in small cage.)

*p* *mf* *f* *p*

Combination Long Call

♩ = 256

(During play, isolation or when socially disturbed. When animal not in contac

Descending Multi-whistle

♩ = 204

(Same as Ascending Multi-Whistle and Terminally Modulated Whistle. More commonly given to infants.)

Type f Chirp

♩ = 216

(During intergroup antiphonal calling of Normal Long Calls. To audible outgroup vocalizations.)

Flatwhistle

♩ = 216

(Given following Type F, H or E Chirp Trills)

FIG. 3A2

2

Hooked Chatter

♩. = 252

(Same as Type D Chirp (food related). As infants approach.)

Inverted U + Whistle

♩ = 288

(In alarm to faint acoustical stimuli after an alert has been signaled.)

Large Modulated Multi-Level

♩ = 276

(Given greater than 0.6 m from other animals in low arousal situation
Not given during resting, grooming, nursing,
except occasionally when animals break contact.
Occurs during Antiphonal Call play)

(cough/bark)

Normal Long Call

♩ = 200

(To distant non-group Combination Long Calls, Normal Long Calls,
Type F Chirps. During isolation.)

gliss gliss

*f*

Partial Quiet Long Call (intragroup)

♩ = 320

(By mothers nursing infants. By subadults during
close huddle contact and pauses during wrestle play.)

*p*

Rapid Whistles

♩. = 276

(Before an approach to mount during Anti-phonal Call play.)

*pp* *p* *mp* *mf*

FIG. 3A3
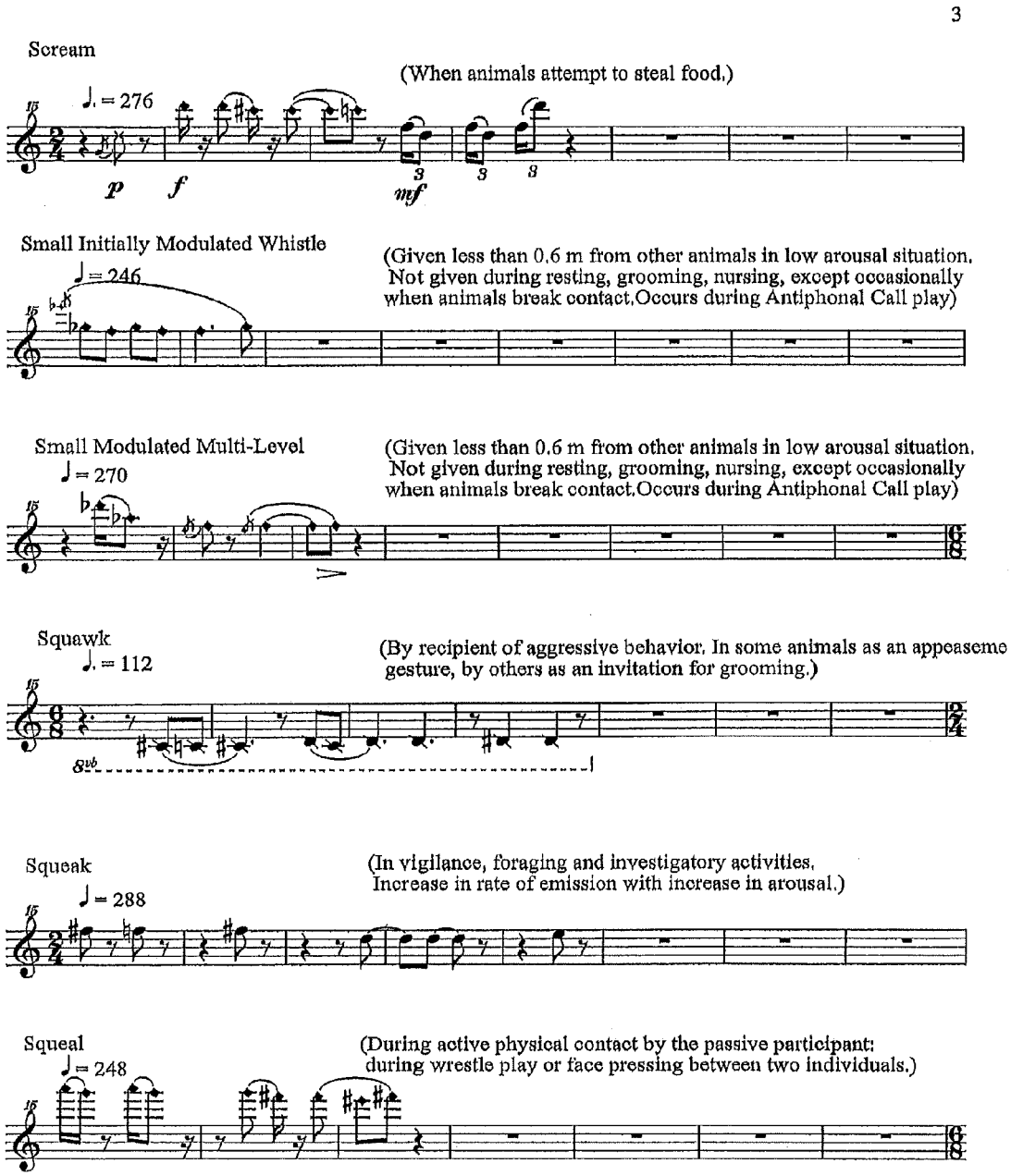

FIG. 3A4
4
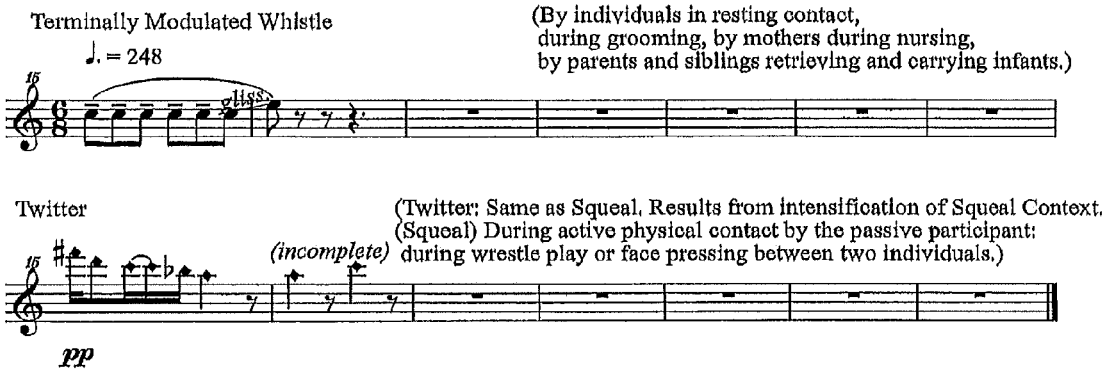

Figure 3B - Ani's calls
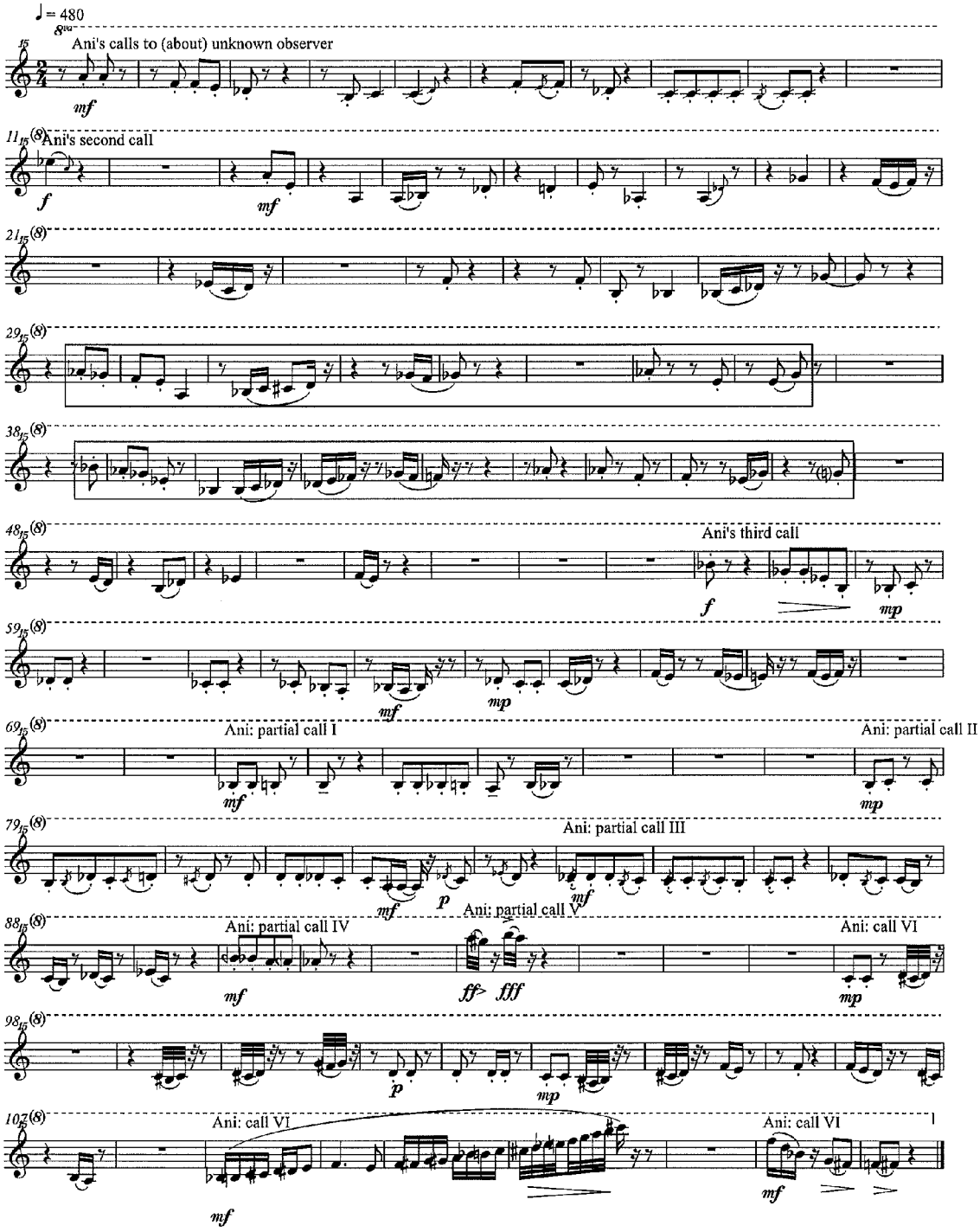

FIG. 3C1
Tamarin Agitato
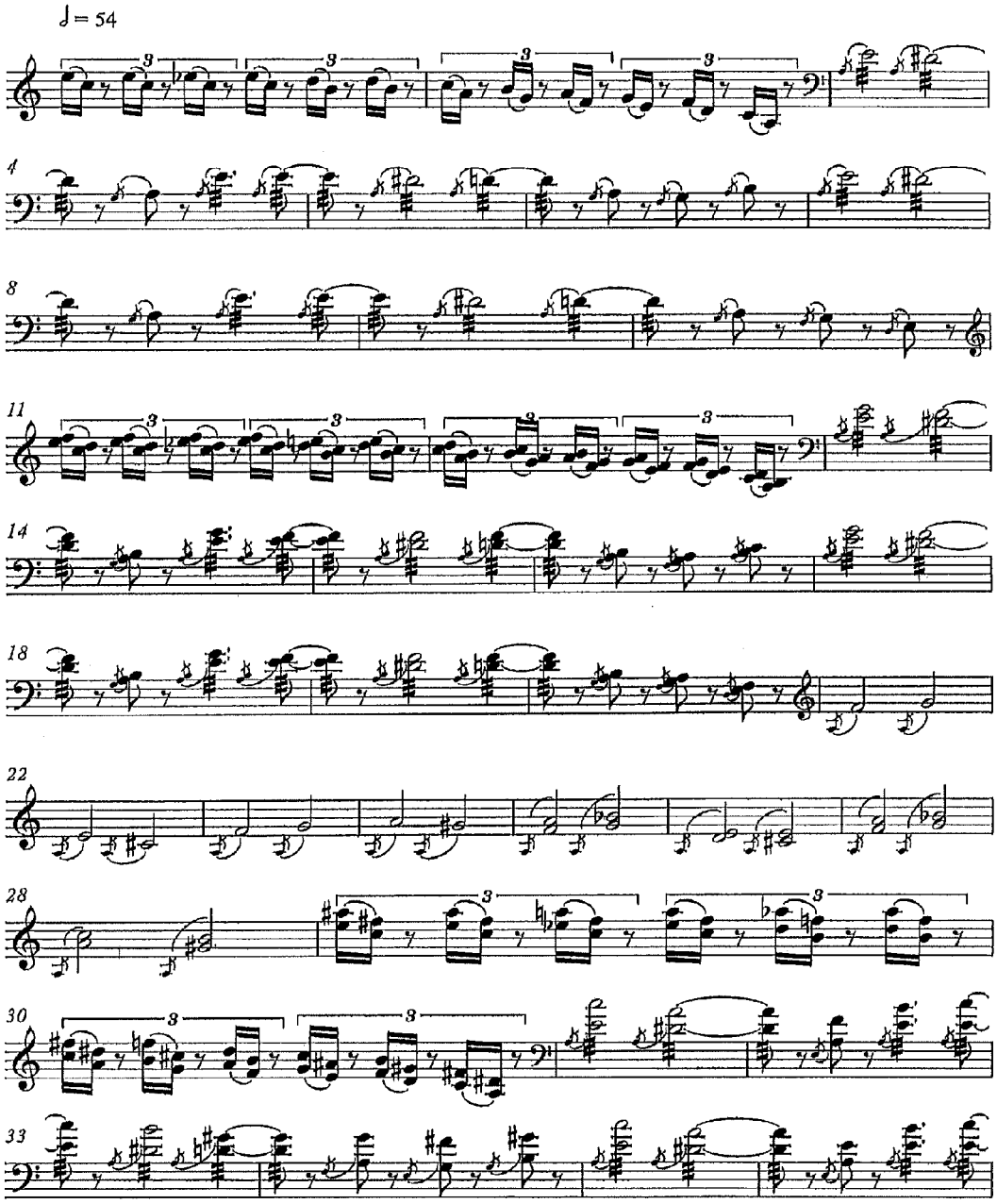

FIG. 3C2
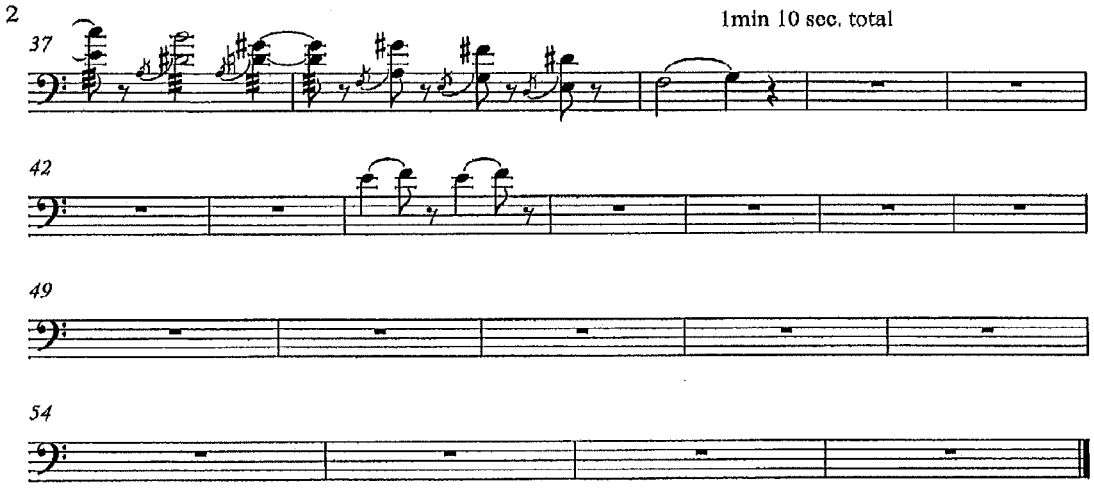

Responses from the amygdala to musical call

Local Field Potentials

Single unit activity

PROCESS OF AND APPARATUS FOR MUSIC ARRANGEMENTS ADAPTED FROM ANIMAL NOISES TO FORM SPECIES-SPECIFIC MUSIC

FIELD

An object of this application is to provide a method of producing sounds, specifically music, that are arranged in a specific manner to create a predetermined environment, for example, this disclosure contemplates forming "species-specific music."

BACKGROUND

Music is generally thought of as being uniquely human in its nature. While birds "sing", it is generally understood that the various sounds generated by animals are for specific purposes, and not composed by the animals for pleasure. The present inventor, however, challenges the presupposition that appreciation of music is unique to *homo sapiens*. The present inventor has devised a method and apparatus for generating music for a wide variety of species of animals.

SUMMARY OF THE INVENTION

Effective implementations of this process and apparatus can generate music that has the potential of inducing certain emotions in domesticated pets and controlling their moods to a degree, such as calming cats and dogs when their owners are away. Further, farm animals often undergo stress, which is not healthy for the animal and diminishes the quality and quantity of the yield of the animal products. Further, wild animals, such as whales beaching themselves or dolphins becoming entangled in nets, rodents invading buildings, as well as geese and other flocking birds occupying the flight paths at airports create a need for a creative way to either attract, repel, calm or excite wild animals.

The present invention includes a process and apparatus for generating musical arrangements adapted from animal noises to form species-specific music. The invention can be used to solve the above problems, but is not so limited. In an exemplary embodiment, the invention can be embodied as an apparatus and process of forming species-specific music, comprising process and means for carrying out steps of: (1) recording sounds created by a specific species in environmental states; (2) identifying elemental sounds of the specific species; (3) associating specific elemental sounds with presupposed emotional states of the specific species; (4) identifying sounds of at least one musical instrument that has a characteristic approximating at least one aspect of at least one elemental sound associated with the specific species; and (5) selectively generating at least one sound identified among sounds of musical instruments that mimic at least one aspect of at least one elemental sound associated with said specific species, but the generated sound is not a recording or recreation of the detected sounds of the specific species.

BRIEF DESCRIPTION OF THE DRAWINGS

FIGS. 3A-3C show exemplars of a species-specific music;

DETAILED DESCRIPTION

Figure 1:
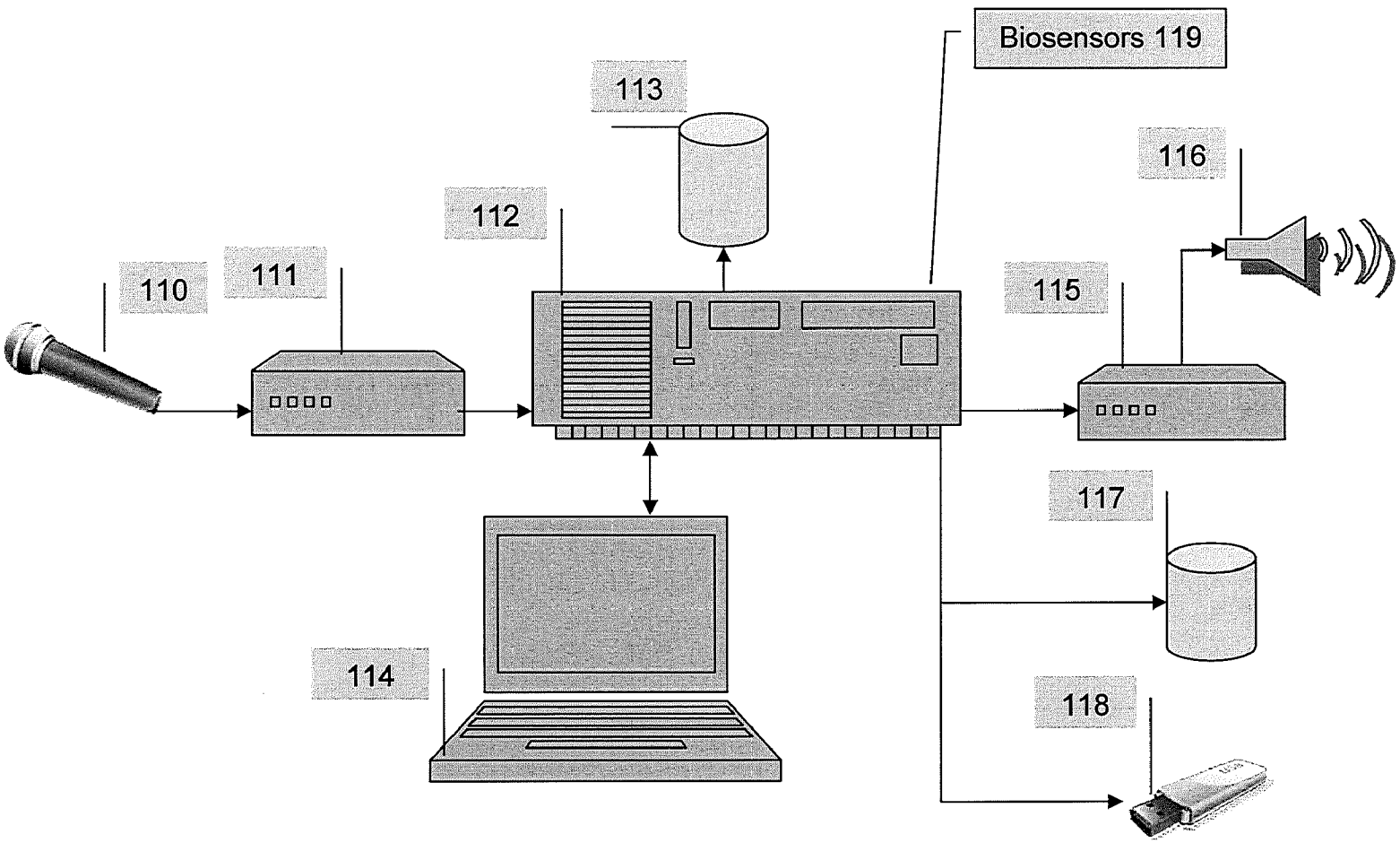
FIG. 1 is an exemplary apparatus for carrying out the present invention.

An exemplary embodiment of an apparatus for carrying out the disclosed process of forming species-specific music is illustrated in FIG. 1. FIG. 1 includes a sound transducer (e.g., microphone, underwater microphone, transducers attachable to skin and/or other tissue, or fur of a specific species, etc.) capable of transforming sound waves into an electrical signal. The sound transducer can be capable of transducing sound in the range of human hearing, or can be specific to or additionally include frequencies outside that of human hearing, i.e., such as infrasound (frequencies below the range of human hearing) and ultrasound (frequencies above the range of human hearing). The sound transducer 110 ideally picks up sound energy that the specific species for which music is to be composed has been determined to capable of hearing. The electrical signals from the sound transducer 110 may be input to an optional sound digitizer 111, which can be as simple as analog to digital converter. In other alternative embodiments, a purely analog signal can be processed, but the present exemplary embodiment is designed to be used with digital, binary computers. In another alternative, digitization of the signals from sound transducer 110 can be done in a species-specific music processor 112.

The digitized sound from the sound digitizer 111, or alternatively analog sound signal, is input to the species-specific music processor 112. The species-specific music processor 112 has a number of functions. It includes as a main software component digital audio editor, which is a specific computer application for audio editing, i.e. manipulating digital audio. Digital audio editors can also be embodied as specific purpose machines. The species-specific music processor 112 can be designed to provide typical features of a digital sound editor, such as the following. The species-specific music processor 112 can allow the user to record audio from one or more inputs (e.g., transducer 110) and store recordings as digital audio in the computer's memory or a separate database (or any form of physical memory device, whether magnetic, optical, hybrid, or solid state, collectively shown as database 117 in FIG. 1). The species-specific music processor 112 can also permit editing the start time, stop time, and duration of any sound on the audio timeline. It can also fade into or out of a clip (e.g. an S-fade out after a performance), or between clips (e.g. cross-fading between takes).

Additionally, the species-specific music processor 112 can mix multiple sound sources/tracks, combine them at various volume levels and pan from channel to channel to one or more output tracks. Additionally, it can apply simple or advanced effects or filters, including compression, expansion, flanging, reverb, audio noise reduction and equalization to change the audio. The species-specific music processor 112 can optionally include frequency shifting and tone or key correction. It playback sound (often after being mixed) that can be sent to one or more outputs (e.g., speakers(s) 116), such as speakers, additional processors, or a recording medium (species specific music database 117 and memory media 118). the species-specific music processor 112 can also convert between different audio file formats, or between different sound quality levels.

As is typical to digital audio editors, these tasks can be performed in a manner that is both non-linear and non-destructive, and perhaps more importantly, it can visualize (e.g. via frequency charts and the like) the sound for comparison either buy a human or electronically through a graph or signal comparison program or device, as are known in the art. A clear advantage of the electronic processing of the sound signals is that the sounds do not have to be within human sensing, comprehension or understanding, particularly when the sounds are at very high or low frequencies outside the range of human hearing.

Because the species-specific music processor 112 can manipulate electrical sound signal by expanding it in time, shrinking it in time, shifting the frequency, expanding the frequency range (and/or nearly any other manipulation of electrical representations of signals that are known or developed in the prior art), finding similar sounds to those of a specific species is not limited by human auditory senses or sensibilities. In this way, the species-specific music processor 112 can access recorded sounds of musical instruments (e.g., traditional wind, percussion, string instruments as well as music synthesizers), the digital sound signals from which can be manipulated as described above, and run through a waveform or other signal comparator until a list of closest matches is found. Human judgment or an electronic best match is then associated with the particular sound of the specific species that is currently being analyzed. Of course, there may be instances in which the music from various instruments can match up to sounds from a particular species without manipulation.

A purpose of manipulating the sound is to be able to visualize and/or compare the sound to other sound-generating sources. That is, the high pitched, high frequency sounds from a bat may not resemble that of an oboe, but when frequency shifted, contracted, expanded or otherwise manipulated, the sound signals can, in theory, be similar or mimic each other. In this way, sounds that have been identified as corresponding to a presupposed emotional state of a specific species can be used to build a system of notes using musical instruments to form music that the specific species can react to in a predictable fashion.

By reversing the sound manipulation (if any) that was performed on the digital sound signal from the specific species, and performing the reverse process on the digital music, sounds generated by musical instruments can be in the frequency range that can be comprehensible to the specific species.

This process of manipulating the sounds in various ways can be done either manual or in an automated fashion, and can include comparing the manipulated sound signatures (i.e., various combinations of characteristics of the sounds, such as pitch, frequency, tone, etc.) of the specific species and various musical instruments stored in a database of sounds.

Hence, the database 113 can store sounds of various musical instruments, which are then manipulated by the synthesizers through best match algorithms, which may manipulate various characteristics by stretching, frequency shifting, frequency expansion or contraction, etc., or the manipulated sounds from the specific species can be compared against pure sounds of the database, or vice versa, pure sounds of the species can be compared against manipulated sounds from the database of sounds.

The species-specific music processor 112 may include a specific program such as an aversion of a Adobe Audition or Logic Pro software that is available as of the filing date of the present application. However, there are many different audio editors and sound synthesizers, both in the form of dedicated machines and software, the choice of which is not critical to the invention. As shown in FIG. 1, the species-specific music processor 112 is connected to a laptop computer 114, but it should be noted that the species-specific music processor 112 can be separate from or part of the laptop computer, depending how it is implemented.

Once sounds are identified that mimic the sounds of the specific species, the output can then input to an amplifier 115. The amplifier is generally part of the audio editor of the species-specific music processor 112, but is shown hear as an alternative or additional feature such as for projecting sound over a large distance or area, or remotely, which converts the electrical signal into analog signal for generation through a speaker 116 for instance. The sound transducer (e.g., speaker, underwater speaker, solid surface transducer, etc., as appropriate to the species) 116 may be capable of generating sounds within a specific range as identified as being the hearing range of the specific species, whether it is within the human hearing range, or may include one or both of infrasound and ultrasound capabilities.

Additionally, the amplified and formatted sound recordings can be stored on a physical memory media, such as a magnetic recording media, an optical recording media, hybrid recording media, solid state recording media, or nearly any other type of recording media that currently exists or is developed thereafter.

As also shown in FIG. 1, biosensors 119 such as EKGs, such as electromiographs, feedback thermometers, electrodermographs, electroencephalographs, photoplethysmographs, pneumographs, capnometers, hemoencephalographs, among others, can be used to determine responses to sounds and music from a specific species. The biosensors 119 can send back into the species-specific music processor 112 or a laptop 114 as a mechanism to measure presupposed emotional states of the species. For instance, the biosensors 119 can record the heart rate of breeding age females of the species to determine the rhythmic sounds that mammals feel in utero or the suckling sounds made ex utero as measures of the species in these pre and postnatal states that presumably are identified with feelings of security and calmness. Biosensors 119 can also measure the various biological signals determine whether an animal is agitated, calm, alert, etc. These biosensors 19 can be coupled with human observation, or some other form of indication from the species themselves as to the emotional state of the species so as to form a compilation of baseline parameters that indicate a presupposed emotional state. It may be that humans cannot be completely confident that they understand the emotional state of non-human animals, certain approximations can be made at least with respect to core emotions and these measured parameters from the biosensors 119 can be used to associate various sounds from the specific species with an emotional state. Of course, this data can be compiled outside the device and downloaded into the computer through other means.

Type of Species Specific Sounds

Species-specific music can include: 1) reward-related sounds, such as those present in the sonic environment as the limbic structures of a given species are organized and have a high degree of neural plasticity; 2) applications of components of emotional vocalizations of a species; and/or 3) applications of components of environmental sonic stimuli that trigger emotional responses from a species. It is noted that playback equipment can be specifically calibrated to include the complete frequency range of hearing of a particular targeted species along with a specific playback duration and intervals that can be timed to correspond, for example, to a feral occupation of the species.

Frequency range—The vocalizations of a mammalian species can be recorded and categorized as mother to infant affective, submissive, affective/informational, play, agitated/informational, threat, alarm, and infant distress, etc. The frequency range of each category can be used in music, such as the music contemplated herein, and can be intended to evoke relevant emotions. For example, if a mother to infant affective vocalizations use frequencies from 1200 to 1350 Hz, then ballad music for that species can have melodies that are limited to that particular frequency range for similar effects. Agitating music, correspondingly, can use the frequency ranges of threats and alarms.

Waveform complexity—The vocalizations that have been categorized as listed above can also be analyzed with spectroscopic instruments and Fast Fourier Analyzing software (being part of the species-specific music processor 112) to reveal relative intensities of overtones that indicate the degree of complexity of the recorded sound, for example. The music that is intended to evoke relevant emotions of a given vocalization can be produced with instruments that have similar spectral audio images to a simulated vocalization. For example, a relatively pure sound of a nearly sinusoidal wave produced by a submissive whimper can be played on a flute, piccolo, or bowed/stringed instrument harmonic.

Resonating cavity shape—The vocalizations that have been categorized as listed above can also be analyzed with spectroscopic instruments to reveal relative intensities of overtones that indicate the shape of the resonating cavity of the vocalization, for example. The music that is intended to evoke relevant emotions of a given vocalization can be produced with instruments that have similar resonating cavities to a simulated vocalization. For example, an affective call of the mustached bat is produced using a conical mouth shape that adds recognizable resonance to the vocalization the same way that humans recognize vowels. A musical version of this call could be produced on the English horn, for example, that has a conical bore.

Syllable-pause duration—The durations of pitch variations of various categories can be recorded and each category can also be given a value range. If the impulses of threat vocalizations, for example, occur from 0.006 to 0.027 seconds apart, then corresponding notes of agitating music can be made to correspond to this rate for similar effect.

Phrase length—The ranges of length of phrases of categories of vocalization can also be reflected in exemplary corresponding music arrangements. If alarm calls range from 0.3 to 1.6 seconds, for example, an introductory music section to an arrangement can also contain alarm-like phrase lengths in the music that can similarly last from 0.3 to 1.6 seconds.

Frequency contour—Frequency contours of each category of vocalization can be analyzed and identified. The speed and frequency range of a downward curve of a submissive vocalization, for example, can be used in exemplary music arrangements intended to evoke empathetic/social bonding emotions. The intervallic pitch relationships that can be used in a species' vocalizations can also be used in the corresponding music arrangements intended to engender similar emotional responses to the observed vocalizations. A cotton-topped tamarin, for example, uses an interval of a second primarily in contentious contexts. Intervals of 3rds, 4ths, and 5ths predominate in affective mother-to-infant calls that can serve as bases for calming music.

Limbic structure formation environment—Reward and pleasing sonic elements of an environment of a given species at the time when the limbic structures of an infant and being organized and have a high degree of neural plasticity can be identified. The timbre, frequency range, timing, and contours of these sounds can each be analyzed and can individually, or collectively in any combination, be included in, for example, "ballad" type music as reproduced by exemplary appropriate instruments. If, for example, a suckling of a calf is a broadband sound peaking at 5 kHz separated by bursts of 0.4 seconds with 0.012 seconds between them and contains amplitude contours that peak at ⅓ the length of the burst, then that species' "ballad" music can also contain a similarly contoured rhythmic element as an underlying stream of sound corresponding to the pulse of human music, such as borne of the sound of the human heartbeat.

Environmental stimuli—Sonic stimuli that are a part of the feral environment of a species that trigger emotional responses from a given species may be used as templates for musical elements in species-specific music. The characteristics of vocal communication of mice, for example, will induce an attentive response in the domestic cat and may be used in enlivening music for cats.

Environmental acoustics—Acoustical characteristics of the feral environment of a species may be replicated in the playback of species-specific music. The characteristics of reflected sound found on an open plain—one that lacks reflecting surfaces that could hide predators—could be incorporated into the playback of music for horses, for example. The characteristics of reflected sound that are found in the rainforest canopy could be incorporated into the playback of music for tamarin monkeys, for example.

In exemplary embodiments contemplated herein, normal, feral occupation of a species can be used to determine the parameters of a playback of the species-specific music. If a feral cotton-topped tamarin monkey, for example, spends 55% of its waking hours foraging, 20% in vocal social interaction, 5% in confrontations, 20% grooming, then the music for a solitary, caged cotton-topped tamarin monkey can also contain relevant percentages of activating and calming music programmed to play at intervals during the day that correspond to the normal feral occupation of the animal.

Figure 2:
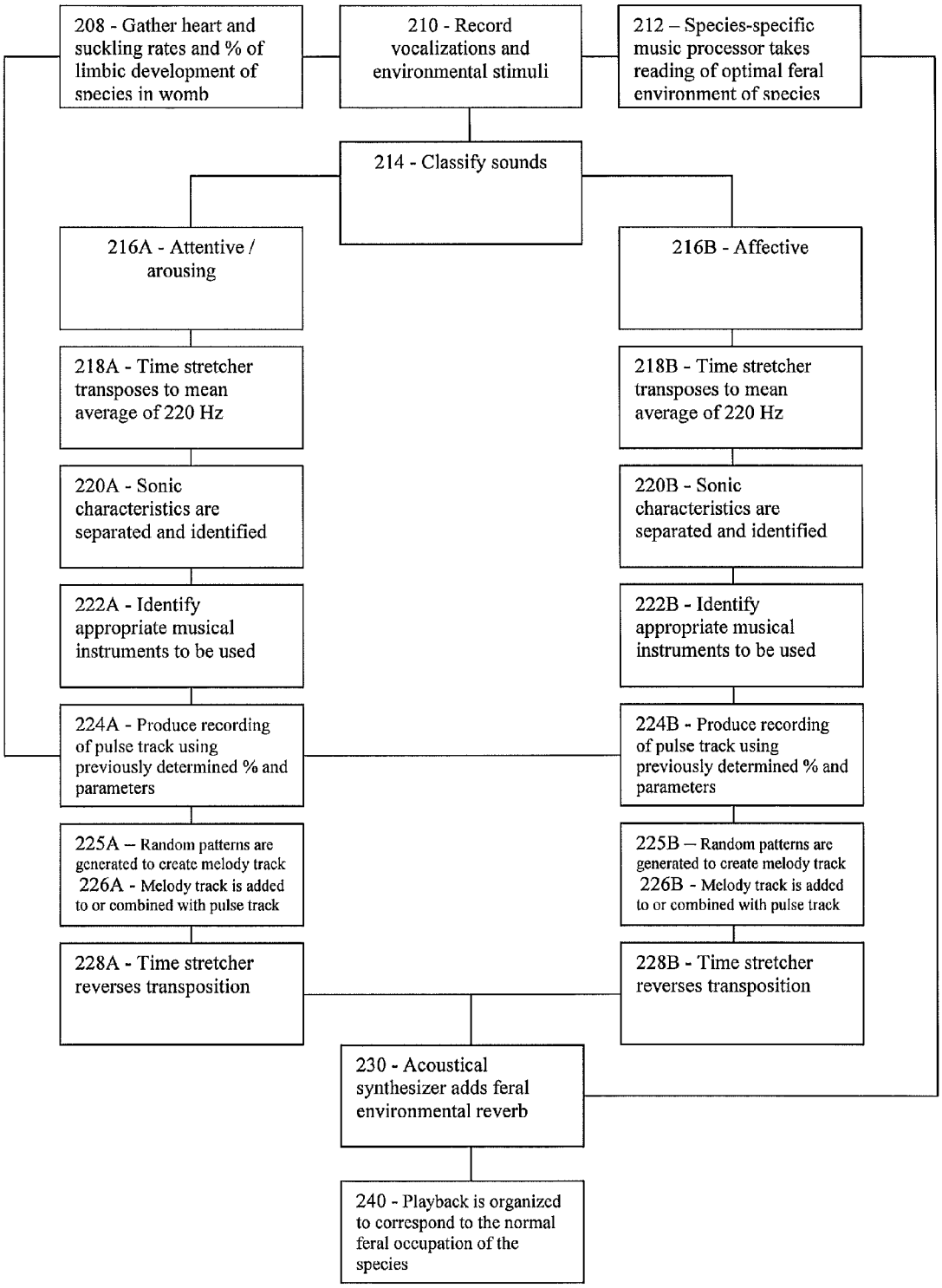
FIG. 2 is a flowchart outlining one implementation of the process of forming species-specific music.

Process of FIG. 2

FIG. 2 illustrates an exemplary process for carrying out the formation of species-specific music. The steps 210, 212, 218 through 240 would typically be carried out in the species-specific music processor 112.

Step 208: Gather data on heart rate and suckling rates, and % of limbic development of species in womb.

Step 210: Records environmental stimuli and animals' vocalizations with infra-sound and ultra-sound capabilities.

Step 212: The species-specific music processor 112 records acoustical environments using a single broadband sound burst, analyzes the arrival times and intensities of the reflected sound, and creates a custom template of the echoes and reverberation times of the recorded environment that can be used in processing sound tracks, for instance.

Step 214, 216A and 216B: Classify sounds as attentive, arousing or affective, in this exemplary embodiment. Further and/or different classification is also envisioned.

Give the similarity in processes at a high level, the two paths are marked "A" and "B", but described once for simplicity.

Step 218: Stretches and compresses sound tracks as much as 20× in this particular embodiment, in the exemplary species-specific music processor 112.

Step 220: Fast Fourier Transformer provides dataset for sound samples and assigns numeric classification of sound complexity: 0=pure waveform, 10.0=white noise.

Step 222: Formant wave analytics identify the shape of a resonating cavity by evaluating vowel sound similarities.

Step 224: Produces graphic images of intensity and frequency contours that display the durations of syllables, pauses, and phrase lengths and uses a highly magnified frequency scale capable of discriminating between 400 Hz and 410 Hz, for example.

Steps 225 and 226: Generate random patterns to create melody track, and melody track is added to or combined with the pulse track. The database 113 contains a library of musical instruments categorized by numeric classification of sound complexity (see above) and resonating cavity shapes—this library is used to identify appropriate instruments to use in recording species-specific music.

Step 228: Time stretcher reverses transposition.

Steps 230-232: Multi-track recorder combines recorded material, processes the custom reverb created by the species-specific music processor 112, and creates sound files for playback on the sound transducer 116, or stored in the music database 117 or on a separate recording media 118.

More Detailed Description of Aspects of Species-Specific Music System—Age Adjustments and Other Factors The species-specific sounds can include the heart rate of an adult female of the species is measured, as is the suckling rate of nursing infants. A comparison of brain size at birth and at adolescence is used to estimate the percentage of limbic system brain structure development has occurred in the womb. The resulting ratio is used to provide a template for the pulse of the music. If the brain size at birth is 40% of the brain size in adolescence, for example, the heart-based pulse/suckling-based pulse ratio will be 4/6. This corresponds to the common time, 60 beats per minute, heartbeat-based onset and decay of the pedal drum used in human music that is based on the heartbeat of the mother heard by the fetus for 5 months while the limbic brain structures are formed.

The vocalizations and potential environmental stimuli of the species are recorded. Potential environmental stimuli would include sounds that indicate the presence of a common prey if the given species is a predator, for example.

The species-specific music processor 112 records a short, broadband sound and takes a reading of the delay times and intensities of the reflected sound. This information is used to configure a reverb processor that can be used to simulate that acoustical environment in the playback of the music. The reading will be taken of the optimal acoustical environment of the species. For example, a tree-dwelling animal will be most comfortable in the peculiar echo of the canopy of a forest and will not be comfortable in the relatively dry acoustic of an open prairie. A grazing animal, on the other hand, will be most comfortable with no nearby reflecting surfaces that could provide refuge to a predator.

The recorded sounds are classified as either attentive/arousing or affective. The attentive/arousing sounds include the sounds of preferred prey and attention calls relating to food discovery, for example. Affective sounds include vocalizations from mother to infant and those expressing appeasement.

The time stretcher of the species-specific music processor 112 slows or speeds the vocalizations to conform to parameters conducive to human recognition. The highest and lowest frequencies of all of the collected calls are averaged and this value will be changed to 220 Hz. If the average of bat calls, for example, is 3.52 kHz, then the calls will be slowed down 16×, for example.

The characteristics of the sounds are identified and separated with the species-specific music processor 112. A Fast Fourier Transformer (FFT) appraises the complexity of the sound by providing a dataset for sound samples and assigns numeric classification of sound complexity: 0=pure waveform, 10.0=white noise. Formant wave analytics identify the shape of a resonating cavity by evaluating vowel sound similarities. Graphic images are produced that show intensity and frequency contours, durations of syllables, pauses, and phrase lengths and uses a highly magnified frequency scale capable of discriminating between 400 Hz and 410 Hz, for example. Patterns are identified and will be used in the musical representations.

Extant musical instruments that have been sampled and categorized in the database of the species-specific music processor 112 are chosen to musically represent relevant vocalizations. An affective call of the mustached bat, for example, uses a relatively pure vocal tone and a conical resonant cavity. An affective musical representation of this sound could include the relatively pure tone of the double-reed instrument with a conical bore, the English horn. Acoustic and electronic musical instruments are used instead of actual recorded vocalizations. This is necessary in order to avoid habituation to the emotional responses generated by the music. Habituation occurs when a given stimulus is identified as non-threatening. Communication between relevant brain structures through the reticular activating system allows non-threatening stimuli to be excluded from conscious attention and emotional response. For example, when a refrigerator's icemaker first turns over it will induce an attentive emotional response. Once humans or other species have identified it as a sound that is not threatening members of the species will habituate to the sound, not noticing when it turns over. A sound that escapes identification will be resistant to habituation. A thumping heard outside a window every night would continue to induce an attentive response as long as it is not identified. Music is insulated from habituation by providing sounds that are similar to those that trigger imbedded recognition/emotional responses and yet are not readily identifiable. The scream, for example, is a human alarm call that activates an emotional response. The qualities of the sound such as frequency, complexity, and formant balance are compared to a sonic template in our auditory processing and if there are enough parameters that match the template it will send a "threat recognition" signal to the amygdala resulting in emotional stimulation. If an electric guitar plays music with the those same frequencies, intensities, and complexity as a human scream, it creates something akin to the 7-point match used to identify fingerprints—it will be close enough to the "scream" template to trigger recognition and initiate an emotional response. The identification of stimuli in music is, however, a mystery. The inability to identify the aspects of music that induce emotional responses allows music to ameliorate the habituation that would otherwise diminish its effectiveness. If the actual calls of a species were to be used in the music for that species the clear identification by the listening members would make the emotional response to the music subject to habituation.

The parameters of pulses that were identified earlier are used when recording the pulse track. For example, if the heart rate of an adult female is 120 beats per minute, the suckling rate of a nursing infant is 220 per minute, and the brain size at birth is 20% of that of an adolescent, then 20% of the music will incorporate the pulse of 120 drum beats per minute and 80% will incorporate a swishing pulse at the rate of 220 per minute. It is a feature of cognitive development that any information that is introduced as a structure is plastic and being organized will tend to remain. The reward-related sounds that are heard as the brain structures responsible for emotions are formed will tend to be permanently appreciated as enjoyable sounds.

The melody track is added to or combined with the pulse track. The melody track uses the instruments playing varied combinations of the previously identified sonic characteristics.

The time stretching function of the species-specific music processor 112 is reversed. In the example above the music for the bats would be sped up 16×, in this exemplary embodiment.

The recording is run through the species-specific music processor 112, where the customized reverb that was created using the results from the optimal feral environment reading is added.

Playback is organized so that the duration of and separation between the musical selections correspond to the normal feral occupation of the species. If an individual of the species normally spends 80% of the time resting, 15% in social interaction, and 5% hunting, then the playback will contain 70% silence, 5% arousing music, and 25% affective music, for example.

Experimental Results—Exemplary Music Arrangements

By way of example, FIGS. 3A-3C show exemplary embodiments of a species-specific music. FIG. 3A, is an adaptation from recorded sounds of a cotton-topped tamarin monkey. Characteristics generalized based on calls made by this monkey species were extracted and molded into musical simulations of vocalized patterns and timbres, for example. This music arrangement was developed through analysis and formation of music by a musician, as assisted by a digital audio editor, rather than an automated computer system, as was the exemplars below.

Figure 4A:
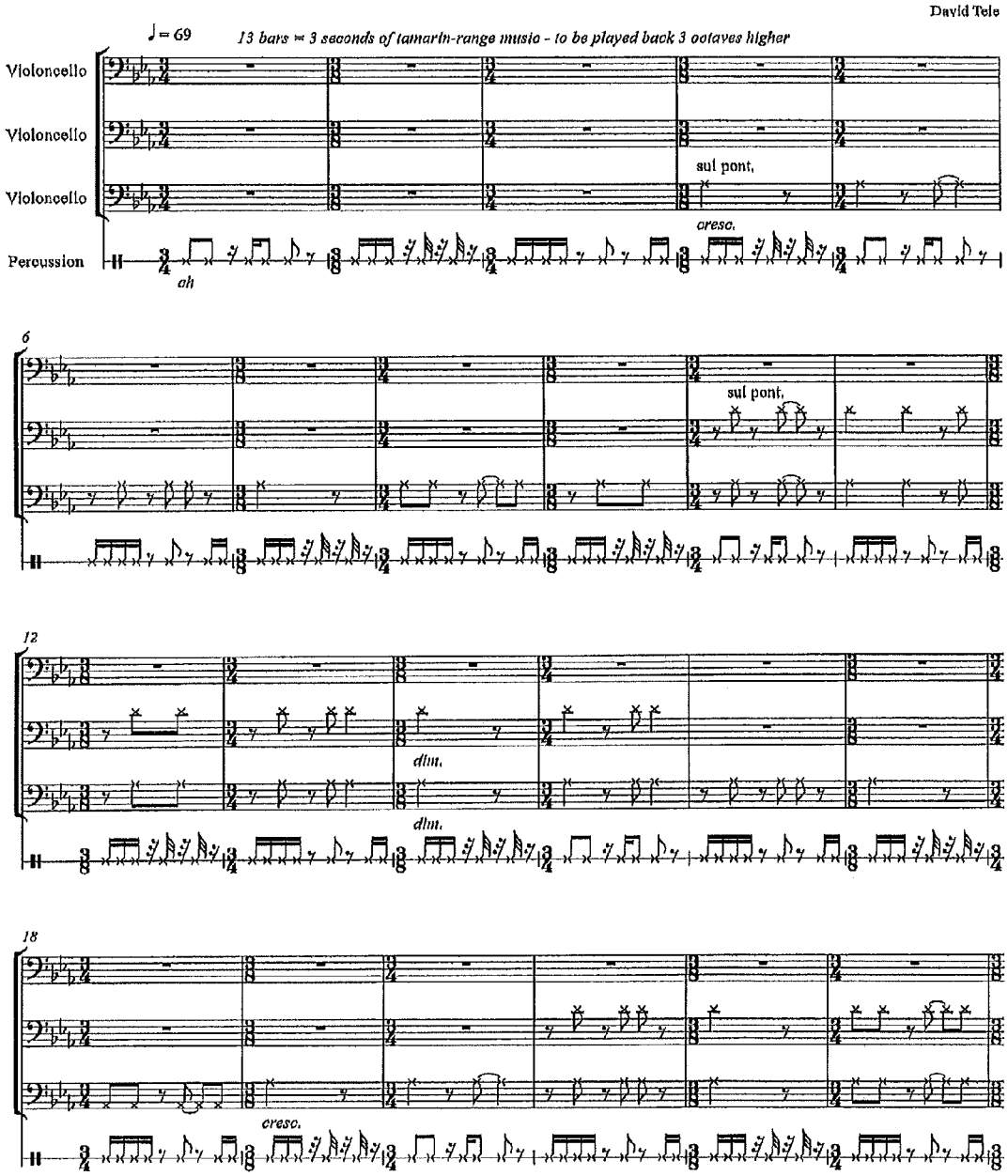
FIG. 4 is an exemplary music arrangement that contains adaptations and compositions based on calls of cotton-topped tamarin monkey.
Figure 4B:
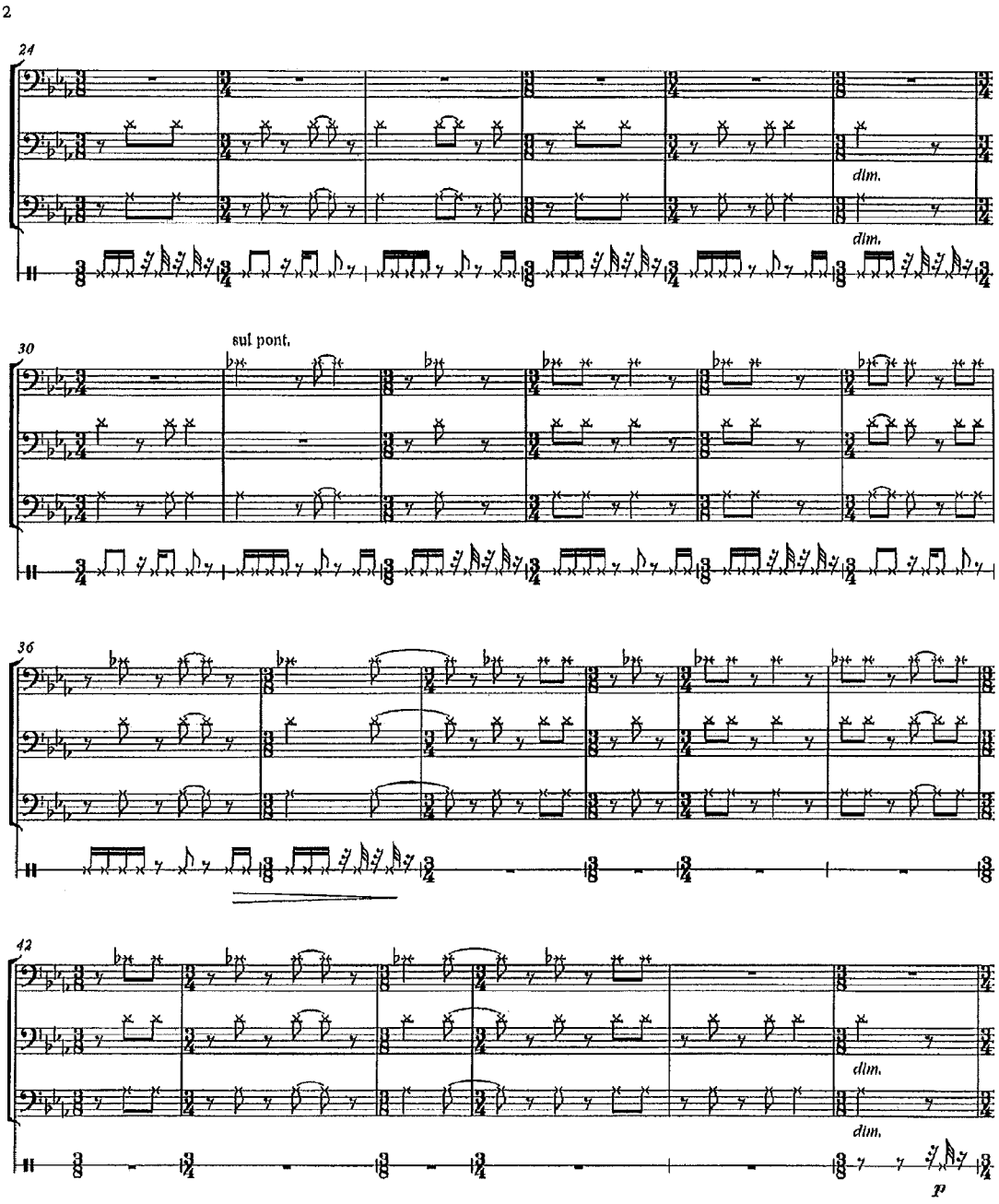
Figure 4C:
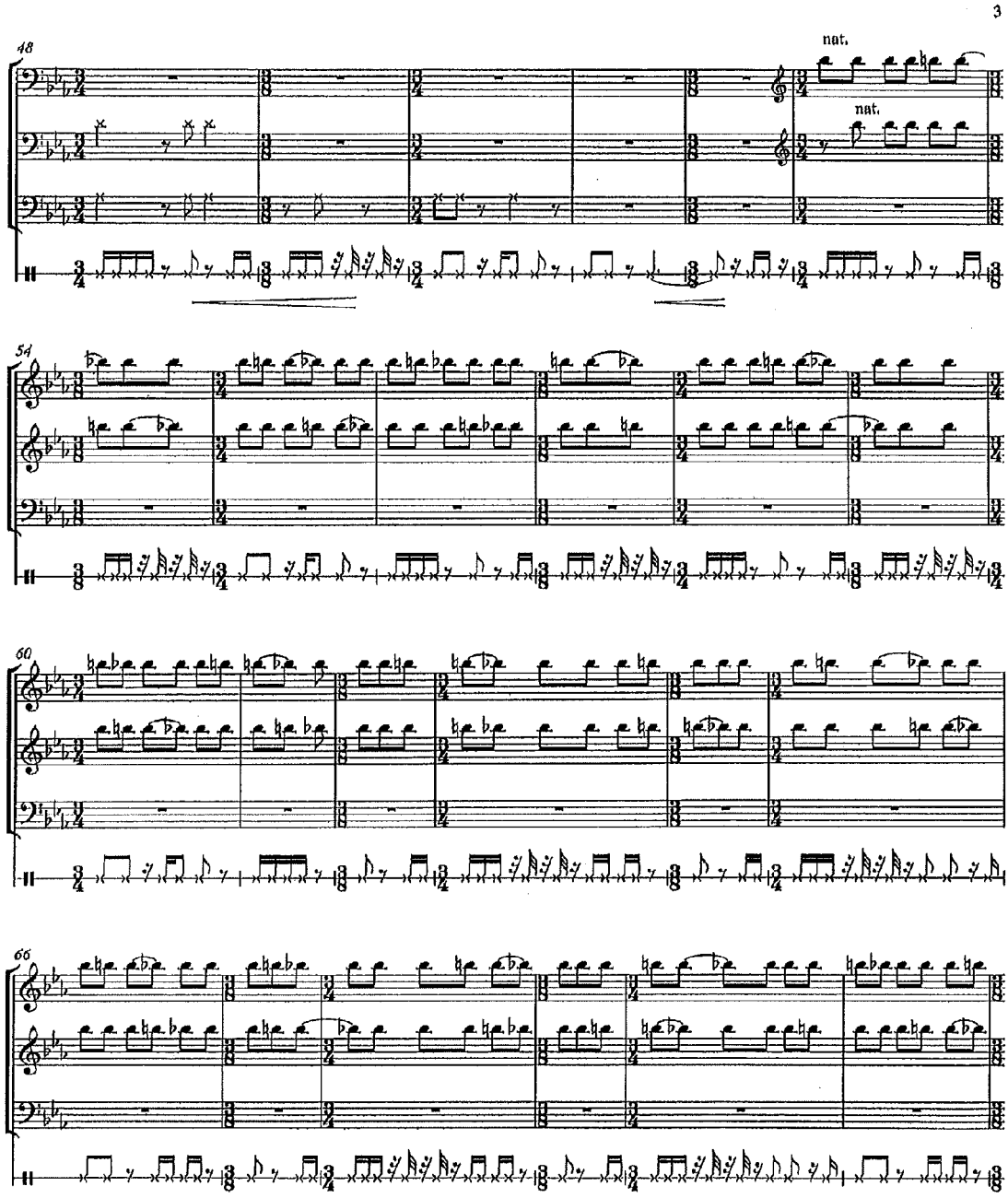
Figure 4D:
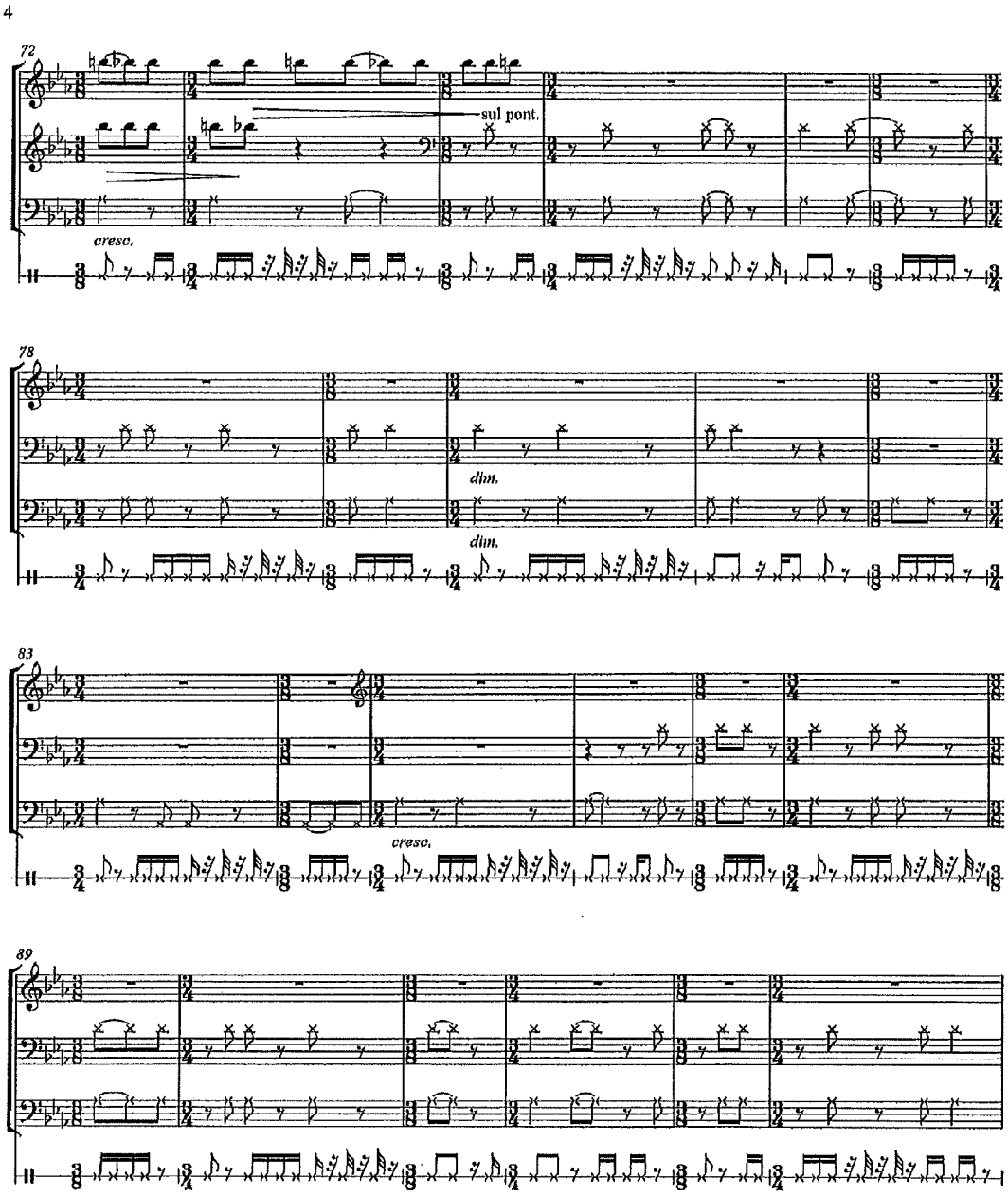
Figure 4E:
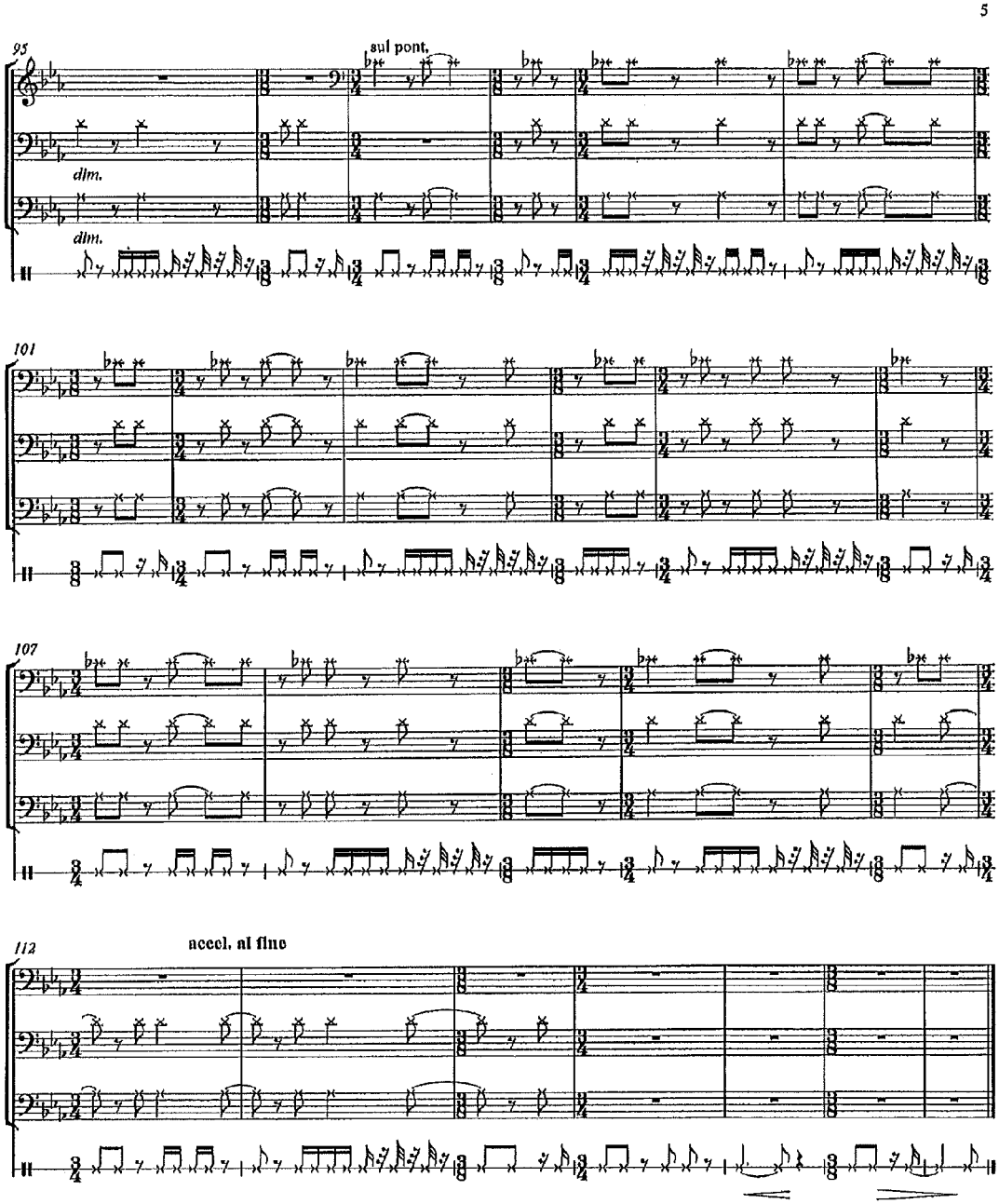
Figure 5:
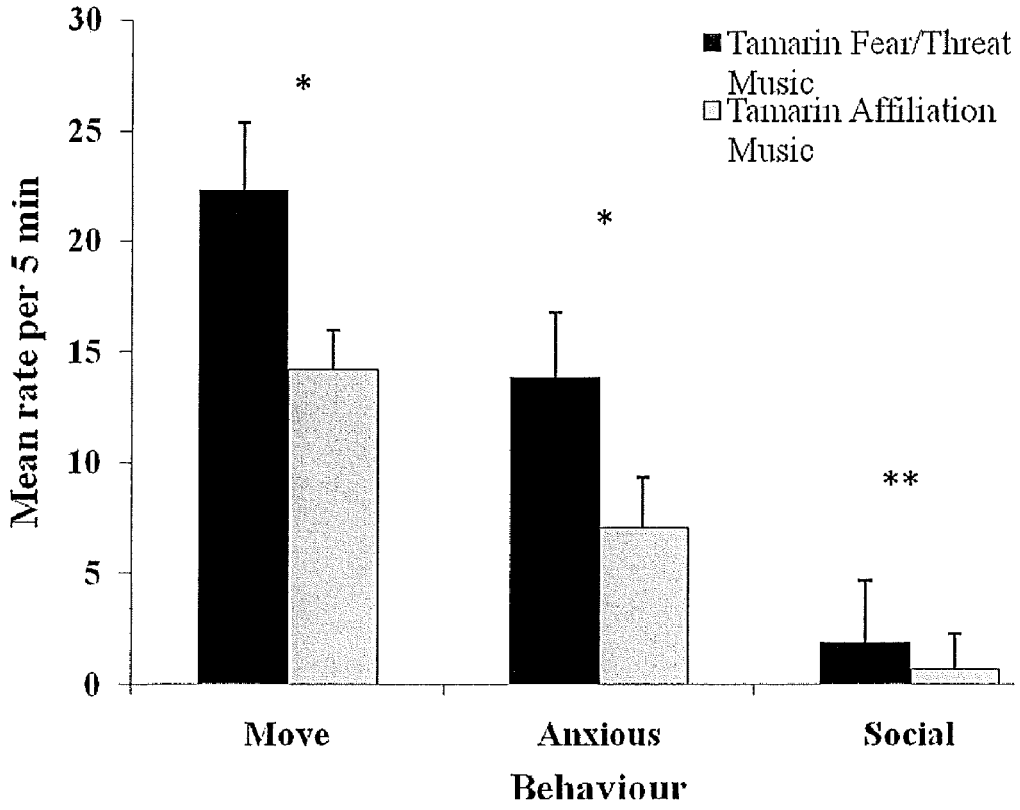
FIG. 5 illustrates responses to tamarin fear/threat-based music versus tamarin affiliation-based music in 5 min following playback (Error bars show SEM, *$p<0.05$, **$p<0.01$)
Figure 6:
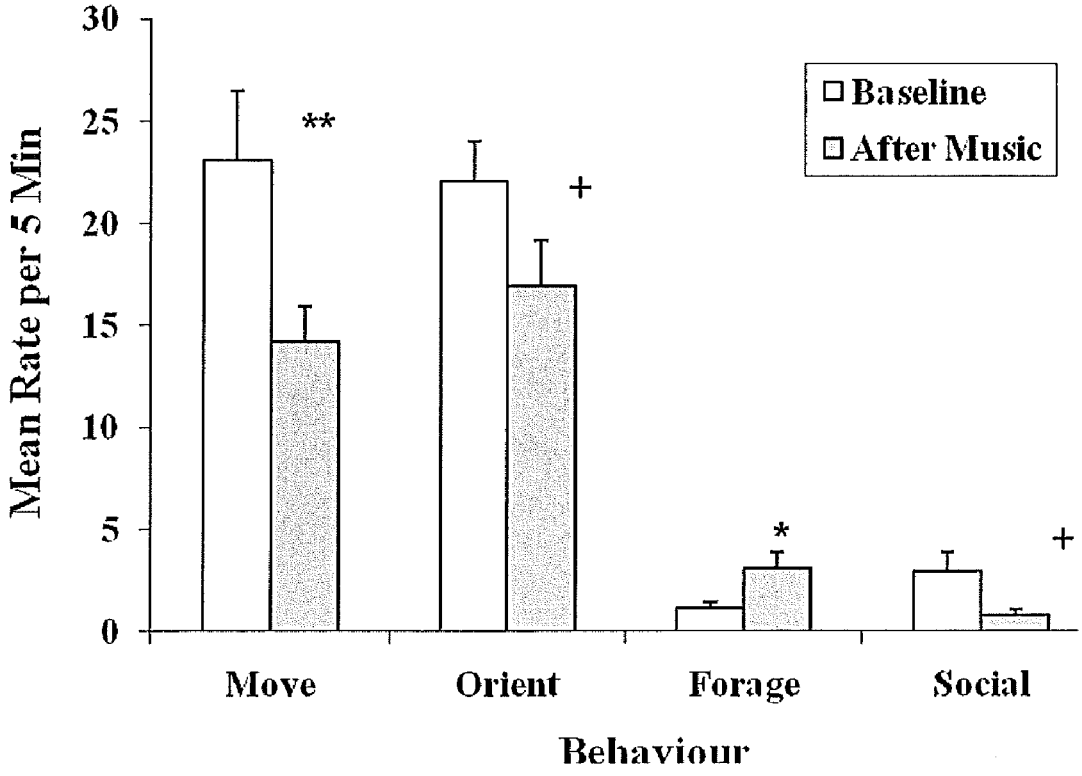
FIG. 6 illustrates responses to tamarin affiliation-based music after playback compared with baseline behavior (Error bars show SEM.+$0.10>p>0.05$, *$p<0.05$, $p<0.01$)
Figure 7A:
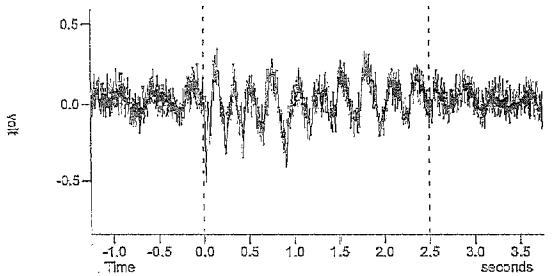
FIGS. 7A through 7**E illustrate experimental results on a mustached bat generated by field potentials of the Amygdala to music generated in accordance with the presently disclosed process.
Figure 7B:
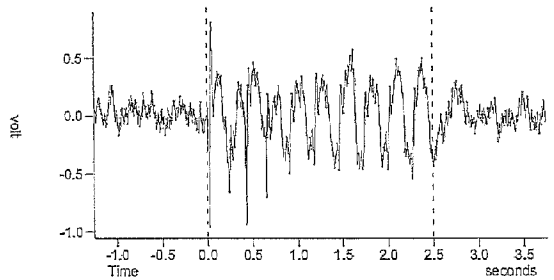
Figure 7C:
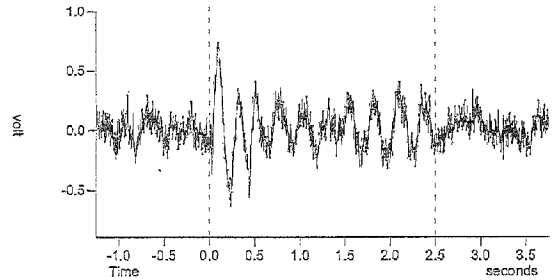
Figure 7D:
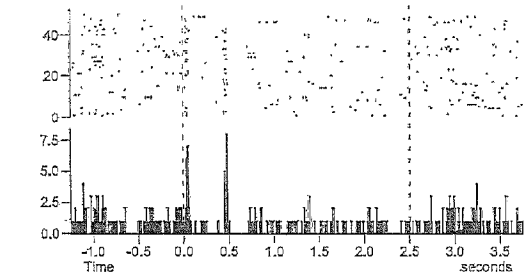
Figure 7E:
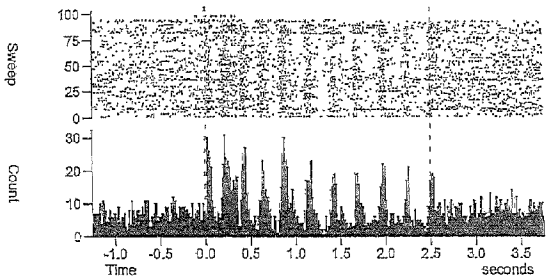

Measure 93 of Ani's calls found on FIG. 3B, for example, is repeated in measures 2 and 3 of "Tamarin Agitato" found on FIG. 3C, and repeated versions of the harsh calls of a Chevron Chatter found on FIG. 3A, second staff, can be found on measures 4, 5, and 6 of FIG. 4D "Wolf and Tamarin I."

FIG. 4 is an exemplary music arrangement that contains adaptations and compositions based on calls of cotton-topped tamarin monkey. Standard note heads demote normal vocal timbre, diamond noteheads denote pure/whistle timbre, and x noteheads denote harsh/broadband timbre.

Experimental Results—Test on human Species

Theories of music evolution agree that human music has an affective influence on listeners. Tests of nonhumans provided little evidence of preferences for human music. But, prosodic features of speech ('motherese') influence affective behavior of nonverbal infants as well as domestic animals, suggesting features of music can influence behavior of nonhuman species. Acoustical characteristics of tamarin affiliation vocalizations and tamarin threat vocalizations were incorporated into corresponding pieces of music. Music composed for tamarins was compared with that composed for humans. Tamarins were generally indifferent to playback of human music, but responded with increased arousal to tamarin threat vocalization based music and with decreased activity and increased calm behavior to tamarin affective vocalization based music. Affective components in human music may have evolutionary origins in the structure of calls of nonhuman animals. In addition animal signals may have evolved to manage the behavior of listeners by influencing their affective state.

In exploring these aspect using clinical protocols, the following predicates where asked. Has music evolved from other species (Brown, S. 2000, The "music language" model of music evolution. In The Origins of Music (eds N. L. Wallin, B. Merker & S. Brown), pp. 271-300. Cambridge, Mass.: MIT Press; McDermott, J. & Hauser, M. 2005 The origins of music: innateness, uniqueness and evolution, Music Percept, 23, 29-59; Fitch, W. T. 2006 The biology and evolution of music: a comparative perspective, Cognition, 100, 173-215.) "Song" is described in birds, whales and the duets of gibbons, but the possible musicality of other species has been little studied. Nonhuman species generally rely solely on absolute pitch with little or no ability to transpose to another key or octave (Fitch 2006). Studies of cotton top tamarins and common marmosets found both species preferred slow tempos. However, when any type of human music was tested against silence, monkeys preferred silence (McDermott, J. & Hauser, M. D. 2007 Nonhuman primates prefer slow tempos but dislike music overall, Cognition, 104, 654-668). Consistent structures are seen in signals that communicate affective state, with high-pitched, tonal sounds common to expressions of submission and fear and low, loud, broad band sounds common to expressions of threats and aggression (Owings, D. H. & Morton, E. S. (1998) Animal Vocal Communication: A new approach. New York N.Y., Cambridge University Press). Prosodic features in speech of parents ('motherese') influences affective state and behavior of infants and similar processes occur between owners and working animals to influence behavior (Fernald, A. 1992 Human maternal vocalizations to infants as biologically relevant signals: An evolutionary perspective. In: The Adapted Mind (eds. J. Barkow, L. Cosmides & J Tooby), pp. 391-428 New York, N.Y.: Oxford University Press, McConnell, P. B. 1991 Lessons from animal trainers: The effects of acoustic structure on an animal's response. In. Perspectives in Ethology (eds. P. Bateson & P. Klopfer), pp. 165-187. New York N.Y.: Plenum Press. Abrupt increases in amplitude for infants and short, upwardly rising staccato calls for animals lead to increased arousal. Long descending intonation contours produce calming. Convergence of signal structures used to communicate with both infants and nonhuman animals suggests these signals can induce behavioral change in others. Little is known about whether animal signals induce affective response in other animals.

Musical structure affects the behavior and physiology of humans. Infants look longer at a speaker providing consonant compared with dissonant music (Trainor, L. J., Chang, C. D. & Cheung, V. H. W. 2002 Preference for sensory consonance in 2- and 4-month old infants. Mus Percept, 20, 187-194). Mothers asked to sing a non-lullaby in the presence or absence of an infant, sang in a higher key and with slower notes to infants than when singing without infants (Trehub, S. E., Unyk, A. M. & Trainor, L. J. 1993 Maternal singing in cross-cultural perspective. Inf Behav Develop, 16, 285-295). In adults upbeat classical music led to increased activity, reduced depression and increased norepinephrine levels whereas softer, calmer music led to an increased well-being (Hirokawa, E. & Ohira, H. 2003 The effects of music listening after a stressful task on immune functions, neuroendocrine responses and emotional states of college students. J Mus Ther, 60, 189-211). These results suggest that combined musical components of pitch, timbre, and tempo can specifically alter affective, behavioral and physiological states in infant and adult humans as well as companion animals.

Why then are monkeys responsive to tempo but indifferent to human music (McDermott & Hauser 2007)? The tempos and pitch ranges of human music may not be relevant for another species. In this study a musical analysis of the tamarin vocal repertoire was used to identify common prosodic/melodic structures and tempos in tamarin calls that were related to specific behavioral contexts. These commonalities were used to compose music within the frequency range and tempos of tamarins with specific motivic features incorporating features of affiliation or of fear/threat based vocalizations and played this music to tamarins. Music composed for tamarins was predicted to have greater behavioral effects than music composed for humans. Furthermore, it was hypothesized that contrasting forms of music would have appropriately contrasting behavioral effects on tamarins. That is, music with long, tonal, pure-tone notes would be calming whereas music that had broad frequency sweeps or noise, and rapid, staccato notes and abrupt amplitude changes would lead to increased activity and agitation.

Material And Methods

Subjects: Seven (7) heterosexual pairs of adult cotton-top tamarins housed in the Psychology Department, University of Wisconsin, Madison, USA, were tested. One animal in each pair had been sterilized for colony management purposes and all pairs had lived together for at least a year. Pairs were housed in identical cages (160×236×93 cm, L×H×W) fitted with branches and ropes to simulate an arboreal environment. Food and water were available ad libitum.

Music selection and composition: Two sets of stimuli representing human and tamarin affiliation based music and human and tamarin fear/threat based music (totaling 8 different stimuli) were prepared for playback to tamarins.

Tamarin music was produced by voice or on an Andre Castagneri (1738) 'cello and recorded on a Sony ECM-M907 one point stereo electret condenser microphone with a frequency response of 100-15,000 Hz with Adobe Audition recording software. Vocal sounds were recorded and played back in real time, artificial harmonics on the 'cello were transposed up one octave in the playback (twice as fast as the original recording), and normal 'cello playing was transposed up three octaves in the playback (eight times faster than the original recording).

Testing: Tamarins were tested in two phases three months apart with each of the four stimulus types presented in each phase. All pieces were edited to approximately 30 s with variation allowing for resolution of chords. The amplitude of all pieces was equalized. Stimuli was prescribed in counterbalanced order across the seven pairs so that 1-2 pairs were presented with each piece in each position. Each pair was tested with one stimulus once a week.

Musical excerpts were recorded to the hard drive of a laptop computer and played through a speaker hidden from the pair being tested. An observer recorded behavior for 5 min baseline. Then the music stimulus was played and behavioral data were gathered for 5 min after termination of the music. The observer was naive to the hypotheses of the study and had previously been trained to a >85% agreement on behavioral measures. Data were recorded using Noldus Observer 5.0 Software.

Data analyses: Data was clustered into five main categories for analysis. Head and body orientation to speaker served as a measure of interest in the stimulus. Foraging (eating or drinking) and social behavior (grooming, huddling, sex) served as measures of calm behavior. Rate of movement from one perch to another was a measure of arousal. Several behaviors indicative of anxiety or arousal (piloerection, urination, scent marking, head shaking, and stretching) were combined into a single measure. Data from both phases for each stimulus type were averaged prior to analysis. First, responses in the baseline condition were examined to determine if behavioral categories differed prior to stimulus presentation. Second, responses to tamarin stimuli versus human stimuli and tamarin fear/threat based music to tamarin affiliation based music were compared for both the playback and the post-playback periods. Third, behavioral responses were compared between baseline and post-stimulus conditions were compared for each stimulus type. Planned comparisons paired sample two-tailed tests with $p<0.05$ and degrees of freedom based on the number of pairs were used.

Results

There were no differences in baseline behavior due to stimulus condition. During the 30 s playbacks there were no significant responses to tamarin music. In the post-stimulus condition there were no effects of human based music. However, there were several differences between the tamarin fear/threat based music and tamarin affiliation based music. Monkeys moved more (fear/threat based 22.3+3.1, affiliation based 14.2+1.75, $t(6)=2.70$, $p=0.036$, $d=1.02$); showed more anxious behavior (fear/threat based 13.86+2.78, affiliation based 7.07+1.56, $t(6)=3.09$, $p=0.021$, $d=1.17$) and more social behavior following fear/threat based music (fear/threat based 1.923+0.45, affiliation based 0.71+0.31, $t(6)=6.58$, $p=0.0006$, $d=2.49$). Compared with baseline tamarins decreased movement following playback of the tamarin affiliation based music (baseline 23.07+3.4 baseline, post stimulus 14.21+1.75 $t(6)=3.77$, $p=0.009$, $d=$1.40) and showed trends toward decreased orientation (baseline 22.07+1.93, post-stimulus 16.93+2.3, $t(6)=2.37$, $p=0.056$, $d=0.90$) and decreased social behavior (baseline 2.93+0.97, post-stimulus 0.79+0.31, $t(6)=2.35$, $p=0.057$, $d=0.89$,). In contrast, foraging behavior increased significantly (baseline 1.14+0.33, post-stimulus 3.07+0.80, $t(6)=2.68$, $p=0.036$, $d=1.01$) (FIG. 2). Following playback of tamarin fear/threat based music orientation increased (baseline 16.57+2.91, post-stimulus 21.1+2.98 $t(6)=--4.53$, $p=0.004$, $d=1.69$). Two significant baseline to post-stimulus comparisons followed playback of human based music. Movement following playback of the human fear/threat based music was significantly reduced (baseline 24.43+1.78, post-stimulus 3.0+0.54, $t(6)=11.77$, $p=0.00002$, $d=4.45$) which contrasts sharply with the increased movement following tamarin fear/threat based music and anxious behavior decreased following playback of the human affiliative based music (baseline 11.36+1.26, post-stimulus 7.93+1.11, $t(6)=2.99$, $p=0.024$, $d=1.13$).

Discussion

Tamarin calls in fear situations were short, frequently repeated and contained elements of dissonance compared with both confident threat and affiliative vocalizations. In contrast to human signals where decreasing frequencies have a calming effect on infants and working animals (McConnell 1991; Fernald, 1992), the affiliation vocalizations of tamarins contained increasing frequencies throughout the call. Ascending two note motives of affiliation calls had diminishing amplitude whereas fear and threat calls had increasing frequencies with increasing amplitude. Tamarins have no vocalizations with slowly descending slides whereas humans have few emotional vocalizations with slowly ascending slides. This marked species difference demonstrates that music intended for a given species may be more effective if it reflects the melodic contours of that species' vocalizations.

Music composed for tamarins had a much greater effect on tamarin behavior than music composed for humans. Although monkeys did not respond significantly during the actual playback, they responded primarily to tamarin music during the 5 min after stimulus presentations ended. Tamarin fear/threat based music produced increased movement, anxious and social behavior relative to tamarin affiliation based music. Increased social behavior following fear/threat based music was not predicted but huddling and grooming behavior may provide security or contact comfort in face of a threatening stimulus. In comparison with baseline behavior, tamarin affiliation based music led to behavioral calming with decreased movement, orientation and social behavior, and increased foraging behavior. Tamarin threat based music showed an increase in orientation compared with baseline. The only exceptions to our predictions that tamarins would respond only to tamarin based music were that human fear/threat based music decreased movement and human affiliation based music decreased anxious behavior compared with baseline. In all other measures tamarins displayed significant responses only to music specifically composed for tamarins. We used two different versions of each type of music and presented each piece just once to each pair using conservative statistical measures. The effects cannot be explained simply by one possibly idiosyncratic composition. The robust responses found in the 5 min after music playback ended suggest lasting effects beyond the playback.

Preferences were not tested, but the effect of tamarin-specific music may account for failures of monkeys to show preference for human music (McDermott & Hauser 2007). Those who have listened to the tamarin stimuli find both types to be unpleasant, further supporting species specificity of response to music. These results with those of McDermott & Hauser (2007) have important implications for husbandry of captive primates where broadcast music is often used for enrichment. Playback of human music to other species may have unintended consequences.

A simple playback of spontaneous vocalizations from tamarins may have produced similar behavioral effects, but responses to spontaneous call playbacks may result from affective conditioning (Owren, M. J. & Rendall, D. 1997. An affect-conditioning model of nonhuman primate vocal signaling. In: Perspectives in Ethology, Vol. 12 (eds. M. D. Beecher, D. H. Owings & N. S. Thompson), pp. 329-346. New York N.Y.: Plenum Press). By composing music containing some structural features of tamarin calls but not directly imitating the calls, the structural principles (rather than conditioned responses) are likely to be the bases of behavioral responses. The results suggest that animal signals may have direct effects on listeners by inducing the same affective state as the caller. Calls may not simply provide information about the caller, but may effectively manage or manipulate the behavior of listeners (Owings & Morton 1998).

The principles, exemplary embodiments and modes of operation described in the foregoing specification are merely exemplary. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the scope of the present invention. Accordingly, it is expressly intended that all such variations, changes and equivalents which fall within the spirit and scope of the present invention as defined herein, be embraced thereby.

What is claimed is:

1. A process of forming species-specific sound compositions to invoke a presupposed emotional state, comprising the steps of:

identifying elemental sounds of the specific species;

associating specific elemental sounds with presupposed emotional states of said specific species;

identifying sounds of at least one musical instrument that has a characteristic approximating at least one aspect of at least one elemental sound associated with said specific species; and selectively generating at least one sound identified among sounds of musical instruments that mimic at least one aspect of at least one elemental sound associated with said specific species to form sound compositions to invoke said presupposed emotional state for said specific species, wherein said generated sound is not a recording or recreation of the detected sounds of said specific species, wherein the step of associating in a computer specific elemental sounds with presupposed emotional states includes accessing a database of elemental sounds of various musical instruments stored on a physical recording device and comparing in a computer at least one sound characteristic of said recorded sound of a specific species against elemental sounds of musical instruments to find elemental sounds that mimic but do not duplicate the elemental sounds of the specific species.

2. The process of claim 1, wherein the step of identifying elemental sounds of the specific species includes the steps of manipulating in an acoustical synthesizer recorded sound of the specific species by at least one of stretching the sound timeline, frequency shifting, and fast Fourier transform analysis.

3. The process of claim 1, further including the step of selectively generating the identified sounds of musical instruments to control domesticated animals.

4. The process of claim 1, further comprising selectively generating the identified sounds of musical instruments to control wild animals.

5. The process of claim 1, wherein the identifying steps and the associating steps are carried out in a specifically programmed computer.

6. The process of claim 1, further comprising the step of recording sounds created by a specific species in emotional states.

7. The process of claim 6, wherein the step of recording sounds of the specific species include at least one of recording infra-sound in a sound transducer having infra-sound capabilities, and recording ultra-sound in a sound transducer having ultra-sound capabilities.

8. The process of claim 1, wherein said specific species is mammalian.

9. A process of forming species-specific sound compositions to invoke a presupposed emotional state, comprising the steps of:

identifying sounds of at least one musical instrument that has a characteristic approximating at least one aspect of at least one elemental sound associated with said specific species;

selectively generating at least one sound identified among sounds of musical instruments that mimic at least one aspect of at least one elemental sound associated with said specific species to form sound compositions to invoke said presupposed emotional state for said specific species, wherein said generated sound is not a recording or recreation of the detected sounds of said specific species;

identifying elemental sounds of the specific species;

associating specific elemental sounds with presupposed emotional states of said specific species; and detecting in a bio-sensor device biological functions of the specific species in order to detect reactions to sounds of the specific species so as to determine a given environment, and reactions to identified sounds of musical instruments, to determine whether a desired emotional state appears to have been induced.

10. A process of forming species-specific sound compositions to invoke a presupposed emotional stage, comprising the steps of:

identifying elemental sounds of the specific species;

associating specific elemental sounds with presupposed emotional states of said specific species;

identifying sounds of at least one musical instrument that has a characteristic approximating at least one aspect of at least one elemental sound associated with said specific species;

selectively generating at least one sound identified among sounds of musical instruments that mimic at least one aspect of at least one elemental sound associated with said specific species to form sound compositions to invoke said presupposed emotional state for said specific species, wherein said generated sound is not a recording or recreation of the detected sounds of said specific species, wherein selectively generating identified sounds of musical instruments includes generating at least one of infra-sound in a sound transducer having infra-sound capabilities and ultra-sound in a sound transducer having ultra-sound capabilities.

11. An apparatus for carrying out a process of forming species-specific music, comprising:

means for recording sounds created by a specific species in environmental states;

means for identifying elemental sounds of the specific species;

means for associating specific elemental sounds with presupposed emotional states of said specific species;

means for identifying sounds of at least one musical instrument that has a characteristic approximating at least one aspect of at least one elemental sound associated with said specific species; and means for selectively generating at least one sound identified among sounds of musical instruments that mimic at least one aspect of at least one elemental sound associated with said specific species, wherein said generated sound is not a recording or recreation of the detected sounds of said specific species.

12. The apparatus of claim 11, wherein the means for recording sounds of the specific species include at least one of a sound transducer capable of recording infra-sound and a sound transducer capable of recording ultra-sound.

13. The apparatus of claim 11, wherein the means for identifying elemental sounds of the specific species includes a species-specific music processor that manipulates recorded sound of the specific species by at least one of stretching the sound timeline, frequency shifting, and fast Fourier transform analysis.

14. The apparatus of claim 11, wherein the means for associating includes a species-specific music processor that associates specific elemental sounds with presupposed emotional states, and accesses a database of elemental sounds of various musical instruments stored on a physical recording device and compares at least one sound characteristic of said recorded sound of a specific species against elemental sounds of musical instruments to find elemental sounds that mimic but do not duplicate the elemental sounds of the specific species.

15. The apparatus of claim 11, further comprising a bio-sensor that detects biological functions of the specific species in order to detect reactions to sounds of the specific species so as to determine a given environment, and reactions to identified sounds of musical instruments, to determine whether a desired emotional state appears to have been induced.

16. The apparatus of claim 11, wherein the means for selectively generating identified sounds of musical instruments includes sound transducer that generates at least one of infra-sound in a sound transducer having infra-sound capabilities and ultra-sound in a sound transducer having ultra-sound capabilities.

17. The apparatus of claim 11, further including a sound transducer that selectively generates the identified sounds of musical instruments to control domesticated animals.

18. The apparatus of claim 11, further including a sound transducer that selectively generates the identified sounds of musical instruments to control wild animals.

19. The apparatus of claim 11, wherein the means for identifying and means for associating parts of a specifically programmed computer.

20. The apparatus of claim 11, wherein said specific species is mammalian.

* * * * *